US011271303B2

(12) United States Patent
Yao et al.

(10) Patent No.: US 11,271,303 B2
(45) Date of Patent: Mar. 8, 2022

(54) ANTENNA, SMART WINDOW, AND METHOD OF FABRICATING ANTENNA

(71) Applicant: BOE Technology Group Co., Ltd., Beijing (CN)

(72) Inventors: Yuan Yao, Beijing (CN); Lei Wang, Beijing (CN); Tuo Sun, Beijing (CN)

(73) Assignees: BOE Technology Group Co., Ltd., Beijing (CN); Beijing University of Posts and Telecommunications, Beijing (CN)

( * ) Notice: Subject to any disclaimer, the term of this patent is extended or adjusted under 35 U.S.C. 154(b) by 36 days.

(21) Appl. No.: 16/756,111

(22) PCT Filed: May 24, 2019

(86) PCT No.: PCT/CN2019/088324
§ 371 (c)(1),
(2) Date: Apr. 14, 2020

(87) PCT Pub. No.: WO2020/140368
PCT Pub. Date: Jul. 9, 2020

(65) Prior Publication Data

US 2021/0226325 A1 Jul. 22, 2021

(30) Foreign Application Priority Data

Jan. 3, 2019 (CN) ..... 201910004275.5
Jan. 3, 2019 (CN) ..... 201910004663.3

(51) Int. Cl.
*H01Q 1/38* (2006.01)
*H01Q 5/35* (2015.01)
(Continued)

(52) U.S. Cl.
CPC ..... *H01Q 5/35* (2015.01); *H01Q 1/36* (2013.01); *H01Q 1/38* (2013.01); *H01Q 21/26* (2013.01)

(58) Field of Classification Search
CPC .. H01Q 1/36; H01Q 1/38; H01Q 5/25; H01Q 5/35; H01Q 9/065; H01Q 9/28
See application file for complete search history.

(56) References Cited

U.S. PATENT DOCUMENTS 5,428,364 A 6/1995 Lee et al.
6,346,913 B1 * 2/2002 Chang ..... H01Q 9/0407 343/700 MS
(Continued)

FOREIGN PATENT DOCUMENTS

CN 1833474 A 9/2006
CN 201048157 Y 4/2008
(Continued)

OTHER PUBLICATIONS

International Search Report & Written Opinion dated Sep. 27, 2019, regarding PCT/CN2019/088324.
(Continued)

*Primary Examiner* — Thien M Le
(74) *Attorney, Agent, or Firm* — Intellectual Valley Law, P.C.

(57) ABSTRACT

An antenna is provided. The antenna includes a substantially transparent base substrate; a first pattern having a first feed point and a second pattern having a second feed point spaced apart from each other; a first feed line electrically connected to the first pattern through the first feed point; and a second feed line electrically connected to the second pattern through the second feed point. A first width along a first direction, of the first pattern, gradually increases along a second direction. A second width along the first direction, of the second pattern, gradually increases along a third direction substan-
(Continued)

tially opposite to the second direction. A third width along a fourth direction, of the first feed line, gradually increases along a fifth direction. A fourth width along a sixth direction, of the second feed line, gradually increases along a seventh direction.

20 Claims, 6 Drawing Sheets

(51) Int. Cl.
*H01Q 21/26* (2006.01)
*H01Q 1/36* (2006.01)

(56) References Cited

U.S. PATENT DOCUMENTS

| | | | | |
|---|---|---|---|---|
| 8,599,079 | B2 * | 12/2013 | Kudo | H01Q 1/3291 343/713 |
| 2004/0051675 | A1 * | 3/2004 | Inoue | H01Q 5/40 343/728 |
| 2004/0217907 | A1 * | 11/2004 | Inoue | H01Q 7/00 343/728 |
| 2005/0088344 | A1 * | 4/2005 | Saitou | H01Q 9/28 343/700 MS |
| 2007/0097009 | A1 * | 5/2007 | Torres | H01Q 1/1271 343/795 |
| 2008/0272981 | A1 * | 11/2008 | Gagne | H01Q 1/38 343/895 |
| 2010/0295750 | A1 * | 11/2010 | See | H01Q 9/0435 343/893 |
| 2011/0037656 | A1 | 2/2011 | Bremner et al. | |
| 2017/0207120 | A1 * | 7/2017 | Boyanov | H01L 21/76849 |
| 2018/0323492 | A1 * | 11/2018 | Daniel | H01Q 15/0086 |
| 2020/0194899 | A1 | 6/2020 | Lu | |

FOREIGN PATENT DOCUMENTS

| | | | |
|---|---|---|---|
| CN | 101188324 | A | 5/2008 |
| CN | 101682110 | A | 3/2010 |
| CN | 105609937 | A | 5/2016 |
| CN | 106848554 | A | 6/2017 |
| CN | 107104277 | A | 8/2017 |
| CN | 108649343 | A | 10/2018 |
| CN | 109066069 | A | 12/2018 |
| JP | H10233612 | A | 9/1998 |
| JP | 2001326518 | A | 11/2001 |
| WO | 2008047953 | A1 | 4/2008 |
| WO | 2018138111 | A1 | 8/2018 |

OTHER PUBLICATIONS

First Office Action in the Chinese Patent Application No. 201910004275 5 dated Aug. 2, 2019; English translation attached.

Second Office Action in the Chinese Patent Application No. 201910004275.5 dated Dec. 30, 2019 English translation attached.

Third Office Action in the Chinese Patent Application No. 201910004275 5 dated Mar. 25, 2020; English translation attached.

First Office Action in the Chinese Patent Application No. 201910004663.3 dated Sep. 10, 2019; English translation attached.

Second Office Action in the Chinese Patent Application No. 201910004663.3 dated May 26, 2020; English translation attached.

N. Guan, et al., "A Monopole Antenna Made of a Transparent Conductive Film", Proceedings of International Workshop on Antenna Technology, Cambridge, UK, pp. 263-266, 2007.

N. Guan, et al., "Basic Study on an Antenna Made of a Transparent Conductive Film", International Symposium on Antennas and Propagation, ISAP 2006.

P. Dreyer, et al. "Copper and Transparent-Conductor Reflectarray Elements on Thin-Film Solar Cell Panels", IEEE Transactions on Antennas and Propagation, vol. 62, No. 7, pp. 3813-3818, Jul. 2014.

M. Iwai, et al., "Design and Implementation of Transparent Multiple-Area RFID Antennas", 2009 Asia Pacific Microwave Conference, Dec. 2009, DOI: 10.1109/APMC.2009.5385475.

Y. Yao, et al., "Design of Optically Transparent Antenna with Directional Radiation Patterns", International Journal of Antennas and Propagation, vol. 2017, Article ID 8125432.

T. Peter, et al., "Miniature Transparent UWB Antenna with Tunable Notch for Green Wireless Applications", 2011 International Workshop on Antenna Technology (iWAT), Mar. 2011, IEEE, DOI: 10.1109/IWAT 2011.5752323.

Y. Yao, et al., "Novel Optically Transparent Antenna for RFID Smart Fitting Room Application", 2015 Asia-Pacific Microwave Conference (APMC), Dec. 2015, IEEE, DOI: 10 1109/APMC.2015. 7413048.

A. Katsounaros, et al., "Optically Transparent Antenna for Ultra Wide-Band Applications", 2009 3rd European Conference on Antennas and Propagation, Mar. 2009, IEEE.

J. Hautcoeur, et al., "Optically Transparent Monopole Antenna with High Radiation Efficiency Manufactured with Silver Grid Layer (AgGL)", Electronics Letters, vol. 45, No. 20, Sep. 24, 2009.

N. Kirsch, et al., "Performance of Transparent Conductive Polymer Antennas in a MIMO Ad-hoc Network", Paper presented at Wireless and Mobile Computing, Networking and Communications (WiMob), 2010 IEEE 6th International Conference.

Y. Yao, et al., "Study on the Optically Transparent Near-Field and Far-Field RFID Reader Antenna", International Journal of Antennas and Propagation, vol. 2014, Article ID 149051.

Decision of Rejection in the Chinese Patent Application No. 201910004275.5, dated May 25, 2020; English translation attached.

He, "Naixiao Research no Antenna Technology Based on optically Transparent Film", Chinese Mater's Theses Full-text Database Information Science and Technology, Aug. 15, 2015, No. 201508.

Gao et al., "Optically Transparent Ballon Antenna", 2015 IEEE International Symposium on Antennas and Propagation & USNC/URSI National Radio Science Meeting, 20151026.

* cited by examiner

ANTENNA, SMART WINDOW, AND METHOD OF FABRICATING ANTENNA

CROSS-REFERENCE TO RELATED APPLICATION

This application is a national stage application under 35 U.S.C. § 371 of International Application No. PCT/CN2019/088324, filed May 24, 2019, which claims priority to Chinese Patent Application No. 201910004663.3, filed Jan. 3, 2019, and Chinese Patent Application No. 201910004275.5, filed Jan. 3, 2019. Each of the forgoing applications is herein incorporated by reference in its entirety for all purposes.

TECHNICAL FIELD

The present invention relates to display technology, more particularly, to an antenna, a smart window, and a method of fabricating an antenna.

BACKGROUND

In general, an antenna is formed using metal materials having good conductive properties. However, those metal materials having good conductive properties are not transparent materials.

SUMMARY

In one aspect, the present invention provides an antenna, comprising a substantially transparent base substrate; a first pattern having a first feed point and a second pattern having a second feed point spaced apart from each other; a first feed line electrically connected to the first pattern through the first feed point; and a second feed line electrically connected to the second pattern through the second feed point; wherein a first width along a first direction, of the first pattern, gradually increases along a second direction substantially perpendicular to the first direction; a second width along the first direction, of the second pattern, gradually increases along a third direction substantially opposite to the second direction and substantially perpendicular to the first direction; a third width along a fourth direction, of the first feed line, gradually increases along a fifth direction substantially perpendicular to the fourth direction; and a fourth width along a sixth direction, of the second feed line, gradually increases along a seventh direction substantially perpendicular to the sixth direction.

Optionally, the first pattern and the second pattern have a two-fold symmetry with respective to a two-fold axis intersecting a midpoint of a line connecting the first feed point and the second feed point, and perpendicular to the substantially transparent base substrate; and the first pattern and the second pattern have a substantially mirror symmetry with respect to a plane of mirror symmetry intersecting the midpoint of the line connecting the first feed point and the second feed point, and perpendicular to the substantially transparent base substrate.

Optionally, the first feed line and the second feed line have a substantially mirror symmetry with respect to the plane of mirror symmetry.

Optionally, the first feed point and the second feed point are closest points between the first pattern and the second pattern with respect to each other.

Optionally, the first pattern, the second pattern, the first feed line, and the second feed line are in a same layer and comprise a same conductive material.

Optionally, the fourth direction and the six direction are substantially perpendicular to the first direction; and the fifth direction and the seventh direction are substantially parallel to the first direction.

Optionally, the first pattern has a substantial isosceles right triangular shape having the first feed point as one of its apexes; and the second pattern has an isosceles right triangular shape having the second feed point as one of its apexes.

Optionally, a first normal distance between the first feed point to aside of the first pattern away from the first feed point is in a range of approximately 10 mm to approximately 100 mm; a second normal distance between the second feed point to a side of the second pattern away from the second feed point is in a range of approximately 10 mm to approximately 100 mm; and a distance between the first feed point and the second feed point is in a range of approximately 0.1 mm to approximately 10 mm.

Optionally, the first feed line and the second feed line have a substantially right triangular shape; and one of two right angle sides of the first feed line is directly adjacent to one of two right angle sides of the second feed line.

Optionally, a first side of the first feed line away from the first feed point has a length in a range of approximately 5 mm to approximately 15 mm; and a second side of the second feed line away from the second feed point has a length in a range of approximately 5 mm to approximately 15 mm.

Optionally, the antenna further comprises a first metal structure and a second metal structure; wherein the first metal structure is electrically connected to a first side of the first feed line away from the first feed point; and the second metal structure is electrically connected to a second side of the first feed line away from the second feed point.

Optionally, a signal emitted from the antenna is in a range of approximately 0.8 GHz to approximately 6 GHz.

Optionally, each of the first pattern and the second pattern comprises indium tin oxide materials.

Optionally, a surface resistance of each of the first pattern and the second pattern is no more than 10 ohms.

Optionally, a thickness of each of the first pattern and the second pattern is in a range of approximately 300 nm to approximately 800 nm.

Optionally, the substantially transparent base substrate is a glass substrate.

In another aspect, the present invention provides a smart window, comprising the antenna described herein or fabricated by a method described herein, and one or more signals lines connected to the antenna In another aspect, the present invention provides a method of fabricating an antenna, comprising forming a substantially transparent base substrate; forming a first pattern having a first feed point and a second pattern having a second feed point spaced apart from each other; forming a first feed line electrically connected to the first pattern through the first feed point; and forming second feed line electrically connected to the second pattern through the second feed point; wherein the first pattern is formed to have a first width along a first direction, and gradually increasing along a second direction substantially perpendicular to the first direction; the second pattern is formed to have a second width along the first direction, and gradually increasing along the third direction substantially opposite to the second direction and substantially perpendicular to the first direction; the first feed line is formed to have a third width along a fourth direction, and gradually increasing along the fifth direction substantially perpendicular to the fourth direction;

and the second feed line is formed to have a fourth width along a sixth direction, and gradually increasing along a seventh direction substantially perpendicular to the sixth direction.

BRIEF DESCRIPTION OF THE FIGURES

The following drawings are merely examples for illustrative purposes according to various disclosed embodiments and are not intended to limit the scope of the present invention.

DETAILED DESCRIPTION

The disclosure will now be described more specifically with reference to the following embodiments. It is to be noted that the following descriptions of some embodiments are presented herein for purpose of illustration and description only. It is not intended to be exhaustive or to be limited to the precise form disclosed.

It is discovered by the present disclosure that in order to have a substantially transparent antenna, the indium tin oxide (ITO) material may be used for making the substantially transparent antenna. However, the antenna made of ITO has a narrow frequency band resulting a poor ability to transmit or receives wide-band signals.

Accordingly, the present disclosure provides, inter alia, an antenna, a smart window, and a method of fabricating an antenna that substantially obviate one or more of the problems due to limitations and disadvantages of the related art. In one aspect, the present disclosure provides an antenna. Optionally, the antenna includes a substantially transparent base substrate; and a first pattern having a first feed point and a second pattern having a second feed point spaced apart from each other; a first feed line electrically connected to the first pattern through the first feed point; and a second feed line electrically connected to the second pattern through the second feed point. Optionally, a first width along a first direction, of the first pattern, gradually increases along a second direction substantially perpendicular to the first direction. Optionally, a second width along the first direction, of the second pattern, gradually increases along a third direction substantially opposite to the second direction and substantially perpendicular to the first direction. Optionally, a third width along a fourth direction, of the first feed line gradually increases along a fifth direction substantially perpendicular to the fourth direction. Optionally, a fourth width along a sixth direction, of the second feed line, gradually increases along a seventh direction substantially perpendicular to the sixth direction.

Figure 1A:
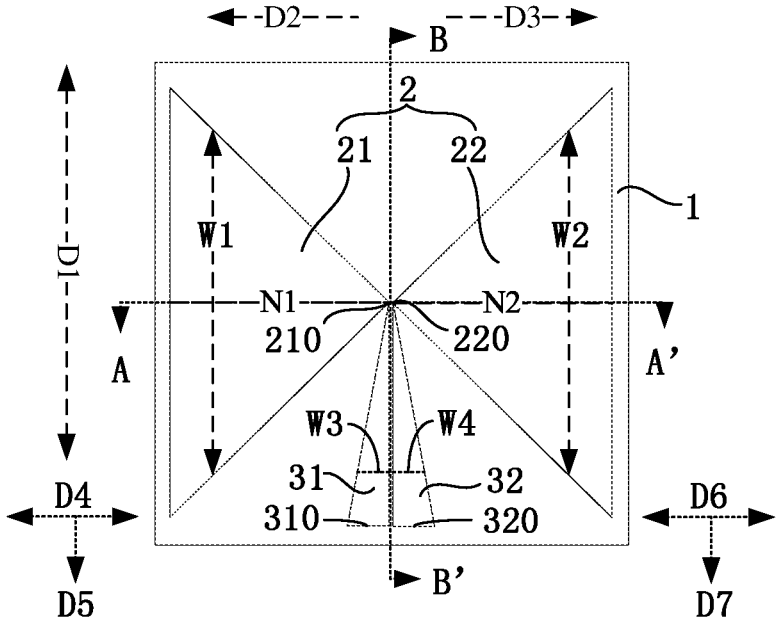
FIG. 1A is a schematic diagram of a structure of an antenna in some embodiments according to the present disclosure.

FIG. 1A is a schematic diagram of a structure of an antenna in some embodiments according to the present disclosure. Referring to FIG. 1A, in some embodiments, an antenna includes a substantially transparent base substrate 1; and a first pattern 21 having a first feed point 210 and a second pattern 22 having a second feed point 220 spaced apart from each other; a first feed line 31 electrically connected to the first pattern 21 through the first feed point 210; and a second feed line 32 electrically connected to the second pattern 22 through the second feed point 220.

As used herein, the term "substantially transparent" means at least 50 percent (e.g., at least 60 percent, at least 70 percent, at least 80 percent, at least 90 percent, and at least 95 percent) of an incident light in the visible wavelength range transmitted therethrough.

Optionally, the first feed point 210 of the first pattern 21 is closer to the second pattern 22. Optionally, the second feed point 220 of the second pattern 22 is closer to the first pattern 21.

Optionally, the substantially transparent base substrate 1 is a glass substrate. Optionally, a dielectric constant $\varepsilon_r$ of the glass substrate is in a range of 8-15. Optionally, a thickness of the glass substrate is in a range of 0.1 mm to 20 mm, which may ensure that the antenna has a better radiation efficiency.

Optionally, the antenna includes a substantially transparent conductive layer on the substantially transparent base substrate 1. Optionally, the substantially transparent conductive layer includes the first pattern 21 and the second pattern 22. Optionally, the substantially transparent conductive layer further includes the first feed line 31 and the second feed line 32. Optionally, the substantially transparent conductive layer is an indium tin oxide (ITO) layer.

In some embodiments, a first width W1 along a first direction D1, of the first pattern 21, gradually increases along a second direction D2 substantially perpendicular to the first direction D1. Optionally, the first pattern 21 extends along the second direction D2 away from the second pattern 22.

As used herein, the term "substantially perpendicular" means that an angle is in the range of approximately 45 degrees to approximately 135 degrees, e.g., approximately 85 degrees to approximately 95 degrees, approximately 80 degrees to approximately 100 degrees, approximately 75 degrees to approximately 105 degrees, approximately 70 degrees to approximately 110 degrees, approximately 65 degrees to approximately 115 degrees, approximately 60 degrees to approximately 120 degrees, or approximately 90 degrees. For example, an angle between the second direction D2 and the first direction D1 is approximately 90 degrees.

In some embodiments, a second width W2 along the first direction D1, of the second pattern 22, gradually increases along a third direction D3 substantially opposite to the second direction D2 and substantially perpendicular to the first direction D1. Optionally, the second pattern 22 extends along the third direction D3 away from the first pattern 21.

As used herein, the term "substantially opposite" in the context of direction means that an included angle between two direction is in the range of approximately 135 degrees to approximately 225 degrees, e.g., approximately 170 degrees to approximately 190 degrees, approximately 160 degrees to approximately 200 degrees; approximately 150 degrees to approximately 210 degrees; approximately 140 degrees to approximately 220 degrees, approximately 135 degrees to approximately 225 degrees, or approximately 180 degrees. For example, an angle between the third direction D3 and the second direction is in the range of approximately 135 degrees to approximately 225 degrees.

In some embodiments, a third width W3 along a fourth direction D4, of the first feed line 31, gradually increases along a fifth direction D5 substantially perpendicular to the fourth direction D4.

In some embodiments, a fourth width W4 along a sixth direction D6, of the second feed line 32, gradually increases along a seventh direction D7 substantially perpendicular to the sixth direction D6.

In some embodiments, the fourth direction D4 and the six direction D6 are substantially perpendicular to the first direction D1. Optionally, the fifth direction D5 and the seventh direction D7 are substantially parallel to the first direction D1.

As used herein, the term "substantially parallel" means that an angle is in the range of 0 degree to approximately 45 degrees, e.g., 0 degree to approximately 5 degrees, 0 degree to approximately 10 degrees, 0 degree to approximately 15 degrees, 0 degree to approximately 20 degrees, 0 degree to approximately 25 degrees, 0 degree to approximately 30 degrees, or approximately 0 degree. In one example, an angle between the fifth direction D5 and the first direction D1 is in the range of 0 degree to approximately 45 degrees. In another example, an angle between the seventh direction D7 and the first direction D1 is in the range of 0 degree to approximately 45 degrees.

In some embodiments, the first pattern 21, the second pattern 22, the first feed line 31, and the second feed line 32 are in a same layer and include a same conductive material. Optionally, the conductive material is a transparent conductive material.

As used herein, the term "same layer" refers to the relationship between the layers simultaneously formed in the same step. In one example, the first pattern 21 and the second pattern 22 are in a same layer when they are formed as a result of one or more steps of a same patterning process performed in a same layer of material. In another example, the first pattern 21 and the second pattern 22 can be formed in a same layer by simultaneously performing the step of forming the first pattern 21 and the step of forming the second pattern 22. The term "same layer" does not always mean that the thickness of the layer or the height of the layer in a cross-sectional view is the same.

Optionally, the first pattern 21 and the second pattern 22 are in a same first layer, the first feed line 31 and the second feed line 32 are in a same second layer, the second layer is on a side of the first layer away from the substantially transparent base substrate 1 to allow the first feed line 31 to be electrically connected to the first pattern 21, and to allow the second feed line 32 to be electrically connected to the second pattern 22.

For example, it is difficult to form a via on the substantially transparent conductive layer containing the first pattern 21 and the second pattern 22, and difficult to weld the first feed line to the first pattern and to weld the second fee line to the second pattern. The antenna adopt same layer two-wire feed mode instead of vertical bottom feed mode. So, the first pattern 21, the second pattern 22, the first feed line 31, and the second feed line 32 are in a same layer.

For example, the first feed line 31 has the third width W3 along the fourth direction D4, of the first feed line 31, gradually increasing along the fifth direction D5 substantially perpendicular to the fourth direction D4. The second feed line 32 has the fourth width W4 along the sixth direction D6, of the second feed line 32, gradually increasing along the seventh direction D7 substantially perpendicular to the sixth direction D6. In order to match an input impedance of the first pattern 21 at the first feed point 210 to a characteristic impedance of the first feed line 31 at the first feed point 210, the third width W3 along the fourth direction D4, of the first feed line 31, is designed to gradually increase along the fifth direction D5 substantially perpendicular to the fourth direction D4. In order to match an input impedance of the second pattern 22 at the second feed point 220 to a characteristic impedance of the second feed line 32 at the second feed point 220, the fourth width W4 along the sixth direction D6, of the second feed line 32, is designed to gradually increase along the seventh direction D7 substantially perpendicular to the sixth direction D6. So, by matching the input impedance of the first pattern 21 to the characteristic impedance of the first feed line 31, and matching the input impedance of the second pattern 22 to the characteristic impedance of the second feed line 32, the antenna can achieve a maximum transmission power, as well as keep the radiation pattern of the antenna stable when transmitting or receiving the ultra-wideband signals.

Various appropriate materials may be used for making the first pattern 21. Examples of materials suitable for making the first pattern 21 include, but are not limited to indium tin oxide (ITO), metal, and a combination of ITO and metal. In one example, the first pattern 21 is made of metal grid. In another example, the first pattern 21 is made of ITO material layer.

Various appropriate materials may be used for making the second pattern 22. Examples of materials suitable for making the second pattern 22 include, but are not limited to indium tin oxide (ITO), metal, and a combination of ITO and metal. In one example, the second pattern 22 is made of metal grid. In another example, the second pattern 22 is made of ITO material layer.

Various appropriate materials may be used for making the first feed line 31. Examples of materials suitable for making the first feed line 31 include, but are not limited to indium tin oxide (ITO), metal, and a combination of ITO and metal. In one example, the first feed line 31 is made of metal grid. In another example, the first feed line 31 is made of ITO material layer.

Various appropriate materials may be used for making the second feed line 32. Examples of materials suitable for making the second feed line 32 include, but are not limited to indium tin oxide (ITO), metal, and a combination of ITO and metal. In one example, the second feed line 32 is made of metal grid. In another example, the second feed line 32 is made of ITO material layer.

Optionally, a surface resistance of each of the first pattern 21, the second pattern 22, the first feed line 31, and the second feed line 32 is no more than 10 ohms, e.g., no more than 2 ohms, no more than 4 ohms, no more than 6 ohms, no more than 8 ohms, no more than 10 ohms, which may allow the antenna to transmit or receive signals efficiently.

Optionally, a thickness of each of the first pattern 21, the second pattern 22, the first feed line 31, and the second feed line 32 is in a range of approximately 300 nm to approximately 800 nm, e.g., approximately 300 nm to approximately 400 nm, approximately 400 nm to approximately 500 nm, approximately 500 nm to approximately 600 nm, approximately 600 nm to approximately 700 nm, and approximately 700 nm to approximately 800 nm. For example, the thicknesses of the first pattern 21, the second pattern 22, the first feed line 31, and the second feed line 32 are 500 nm.

In some embodiments, the first pattern 21 and the second pattern 22 together constitutes an antenna electrode 2 of the antenna.

Figure 1B:
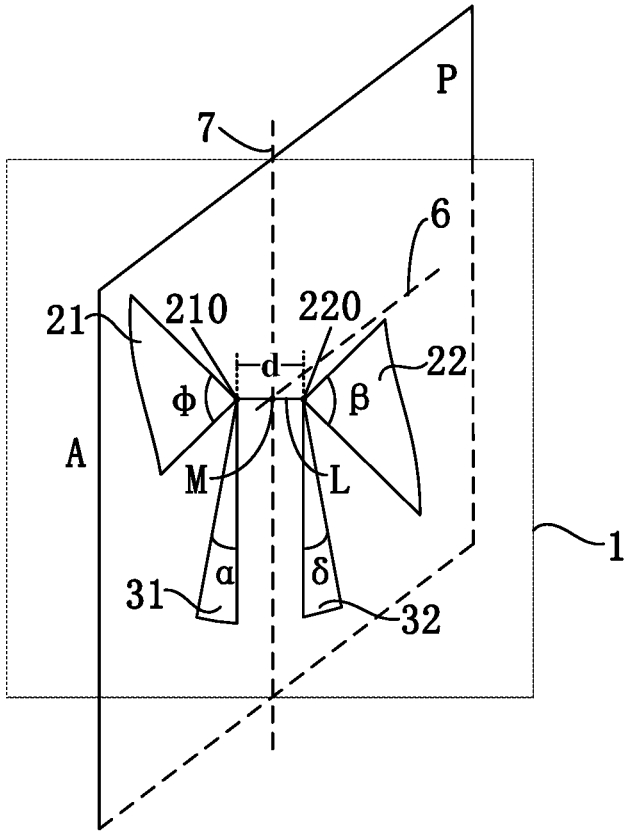
FIG. 1B is a zoom-in view of a first feed point, a second feed point, a first feed line, and a second feed in some embodiments according to the present disclosure.

FIG. 1B is a zoom-in view of a first feed point, a second feed point, a first feed line, and a second feed in some embodiments according to the present disclosure. Referring to FIG. 1A and FIG. 1B, in some embodiments, a first angle $\varphi$ is an acute angle between two sides of the first pattern 21 connecting to the first feed point 210, a second angle $\beta$ is an acute angle between two sides of the second pattern 22 connecting to the second feed point 220. Optionally, the first angle $\varphi$ and the second angle $\beta$ are substantially the same. Optionally, referring to FIG. 1A, the first pattern 21 has a same shape as the second pattern 22.

As used herein, the term "substantially the same" refers to a difference between two values not exceeding 10% of a base value (e.g., one of the two values), e.g., not exceeding 8%, not exceeding 6%, not exceeding 4%, not exceeding 2%, not exceeding 1%, not exceeding 0.5%, not exceeding 0.1%, not exceeding 0.05%, and not exceeding 0.01%, of the base value.

Optionally, a position of the first pattern 21 can be chosen from positions pivoting around the first feed point 210 and without overlapping with the second pattern 22, the first feed line 31, and the second feed line 32. Optionally, a position of the second pattern 22 can be chosen from positions pivoting around the second feed point 220 without overlapping with the first pattern 21, the first feed line 31, and the second feed line 32.

In some embodiments, referring to FIG. 1B, the first pattern 21 and the second pattern 22 have a two-fold symmetry with respective to a first two-fold axis 6 intersecting a midpoint M of a line L connecting the first feed point 210 and the second feed point 220, and perpendicular to the substantially transparent base substrate 1.

Optionally, the first pattern 21 and the second pattern 22 have a substantially mirror symmetry with respect to a plane of mirror symmetry P intersecting the midpoint M of the line L connecting the first feed point 210 and the second feed point 220, and perpendicular to the substantially transparent base substrate 1.

Optionally, the first pattern 21 and the second pattern 22 have a two-fold symmetry with respective to a second two-fold axis 7 on the plane of mirror symmetry P, intersecting the midpoint M, and parallel to the substantially transparent base substrate 1.

The symmetry arrangements of the first pattern 21 and the second pattern 22, the increasing first width W1 of the first pattern 21, and the increasing second width W2 allows the first pattern 21 and the second pattern 22 to have a broadband impedance characteristics, e.g., an ability to transmit or receive broadband signals. So, the antenna having the first pattern 21 and the second pattern 22 described herein has a transparent antenna able to transmit or receives ultra-wideband signals.

In some embodiments, referring to FIG. 1A, the first pattern 21 has a substantially triangular shape. As used herein, the term "substantial triangular shape" can include shapes or geometries having three sides extending along different directions (regardless of whether the three sides include straight lines, curved lines or otherwise).

Optionally, the first pattern 21 has a substantially isosceles triangular shape having the first feed point 210 as one of its apexes. As used herein, the term "substantially isosceles triangular shape" can include a shape or geometry having three sides extending along different directions, two base angles of which are substantially the same. The term "substantially isosceles triangular shape" encompasses isosceles triangular shapes in which the three sides are straight lines, curved lines, or any combination thereof. The term "substantially isosceles triangular shape" also encompass isosceles triangular shapes in which one or more corners are truncated.

Optionally, the first feed point 210 is one of apexes of the first pattern 21. Optionally, the first feed point 210 is an apex of a vertex angle other than two substantially the same base angles of the first pattern 21.

Optionally, the first pattern 21 has a substantially isosceles right triangular shape. As used herein, the term "substantially isosceles right triangular shape" can include a shape or geometry having three sides extending along different direction, two base angles of which are substantially the same, and a vertex angle of which is distinguished from the two base angles and is substantially 90 degrees. The term "substantially isosceles right triangular shape" encompasses isosceles right triangular shapes in which the three sides are straight lines, curved lines, or any combination thereof. The term "substantially isosceles right triangular shape" also encompass isosceles right triangular shapes in which one or more corners are truncated. Optionally, the first feed point 210 is an apex of a vertex angle having substantially 90 degrees among angles of the first pattern 21.

In some embodiment, the second pattern 22 has a substantially triangular shape. Optionally, the second pattern 22 has a substantially isosceles triangular shape. Optionally, the second feed point 220 is one of apexes of the second pattern 22. Optionally, the second feed point 220 is an apex of a vertex angle other than two substantially the same base angles of the second pattern 22.

Optionally, the second pattern 22 has a substantially isosceles right triangular shape having the second feed point 220 as one of its apexes. Optionally, the second feed point 220 is an apex of a vertex angle having substantially 90 degrees among angles of the second pattern 22.

For example, a shape, obtained after rotating the first pattern 21 and the second pattern 22 around the midpoint M for 90 degrees, is complementary to a shape of the first pattern 21 and the second pattern 22. This type of shape of the first pattern 21 and the second pattern 22 allows the antenna having the first pattern 21 and the second pattern 22 to transmit or receive ultra-wideband signals.

In some embodiments, the first pattern 21 has a sectorial shape, the second pattern 22 has a sectorial shape. Optionally, the first pattern 21 has a half elliptic shape, the second pattern 22 has a half elliptic shape.

Figure 2:
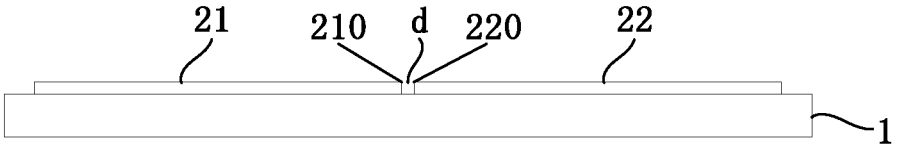
FIG. 2 is a cross-sectional view of a structure of an antenna along an AA' direction in the FIG. 1A.

FIG. 2 is a cross-sectional view of a structure of an antenna along an AA' direction in the FIG. 1A. Referring to FIG. 2, in some embodiments, the first feed point 210 and the second feed point 220 are closest points between the first pattern 21 and the second pattern 22 with respect to each other. Optionally, referring to FIG. 1B and FIG. 2, a distance d between the first feed point 210 and the second feed point 220 determines a maximum frequency with which a signal can be transmitted or received by the antenna. Optionally, an area of the first pattern 21 and an area of the second pattern 22 determines a minimum frequency with which a signal can be transmitted or received by the antenna.

In some embodiments, a first arm length of the first pattern 21 and the second arm length of the second pattern 22 determines the minimum frequency with which a signal can be transmitted or received by the antenna. For example, referring to FIG. 1A, the first arm length of the first pattern 21 is a first normal distance N1 between the first feed point 210 to a side of the first pattern 21 away from the first feed point 210. The second arm length of the second pattern 22 is a second normal distance N2 between the second feed point 220 to a side of the second pattern 22 away from the second feed point 220 also determines the minimum frequency with which a signal can be transmitted or received by the antenna. The longer the first arm length, the lower the minimum frequency signal the antenna can transmitted or receives. The longer the second arm length, the lower the minimum frequency signal the antenna can transmitted or receives.

For example, the first pattern 21 and the second pattern 22 have a substantial isosceles triangular shape. In one example, the first normal distance N1 is a height of the substantial isosceles triangular shape with respect to a side facing the vertex angle other than two substantially the same base angles of the isosceles triangular shape. In another example, the second normal distance N2 is a height of the substantial isosceles triangular shape with respect to a side facing the vertex angle other than two substantially the same base angles of the isosceles triangular shape.

Optionally, a relation between an arm length and the minimum frequency with which a signal can be transmitted or received by the antenna is represented by a following equation:

$$L=\gamma/4((L-97.82)/Z)$$

wherein, L represents the arm length, γ represents the minimum frequency with which a signal can be transmitted or received by the antenna. Z represents an impedance characteristic of an antenna electrode.

Optionally, the impedance characteristic is represented by a following equation:

$$Z=120\ln\cot(\theta/4)$$

wherein θ represents an angle of the antenna electrode with respect to a feed point. Optionally, the angle θ is in a range of approximately 60 degrees to approximately 90 degrees, e.g., approximately 60 degrees to approximately 70 degrees, approximately 70 degrees to approximately 80 degrees, approximately 80 degrees to approximately 90 degrees, and approximately 90 degrees.

For example, the angle θ of the first pattern 21 is the angle φ, the angle θ of the second pattern 22 is the angle β. Because the first pattern 21 and the second pattern 22 both have a same substantial isosceles right triangular shape, the angle φ of the first pattern 21 with respect to the first feed point is 90 degrees, and the angle β of the second pattern with respect to the second feed point is 90 degrees.

Optionally, the first normal distance N1 is in a range of approximately 10 mm to approximately 100 mm, e.g., approximately 10 mm to approximately 20 mm, approximately 20 mm to approximately 30 mm, approximately 30 mm to approximately 40 mm, approximately 40 mm to approximately 50 mm, approximately 50 mm to approximately 60 mm, approximately 60 mm to approximately 70 mm, approximately 70 mm to approximately 80 mm, approximately 80 mm to approximately 90 mm, and approximately 90 mm to approximately 100 mm.

Optionally, the second normal distance N2 is in a range of approximately 10 mm to approximately 100 mm, e.g., approximately 10 mm to approximately 20 mm, approximately 20 mm to approximately 30 mm, approximately 30 mm to approximately 40 mm, approximately 40 mm to approximately 50 mm, approximately 50 mm to approximately 60 mm, approximately 60 mm to approximately 70 mm, approximately 70 mm to approximately 80 mm, approximately 80 mm to approximately 90 mm, and approximately 90 mm to approximately 100 mm.

Optionally, the distanced between the first feed point 210 and the second feed point 220 is in a range of approximately 0.1 mm to approximately 10 mm, e.g., approximately 0.1 mm to approximately 1 mm, approximately 1 mm to approximately 2 mm, approximately 2 mm to approximately 3 mm, approximately 3 mm to approximately 4 mm, approximately 4 mm to approximately 5 mm, approximately 5 mm to approximately 6 mm, approximately 6 mm to approximately 7 mm, approximately 7 mm to approximately 8 mm, approximately 8 mm to approximately 9 mm, approximately 9 mm to approximately 10 mm.

For example, the first pattern 21 and the second pattern 22 have the same substantial isosceles right triangular shape. The first feed point 210 is an apex of a right angle of the first pattern 21. The second feed point 220 is an apex of a right angle of the second pattern 22. The first normal distance N1 of the first pattern 21 is 62 mm. The second normal distance N2 of the second pattern 22 is 62 mm. The distanced between the first feed point 210 and the second feed point 220 is 0.1 mm. So, a signal emitted from the antenna is in a range of approximately 0.8 GHz to approximately 6 GHz, e.g., approximately 0.8 GHz to approximately 1 GHz, approximately 1 GHz to approximately 2 GHz, approximately 2 GHz to approximately 3 GHz, approximately 3 GHz to approximately 4 GHz; approximately 4 GHz to approximately 5 GHz; approximately 5 GHz to approximately 6 GHz.

In some embodiments, referring to FIG. 1B, a third angle α is an acute angle between two sides of the first feed line 31 connected to the first feed point 210, a fourth angle δ is an acute angle between two sides of the second feed line 32 connected to the second feed point 220. Optionally, the third angle α and the fourth angle δ are substantially the same. Optionally, the first feed line 31 has a same shape of the second feed line 32. Optionally, a shape of first feed line 31 is different from a shape of the second feed line 32.

Optionally, a position of the first feed line 31 can be chosen from positions pivoting around the first feed point 210 and without overlapping with the first pattern 21, the second pattern 22, and the second feed line 32. Optionally, a position of the second feed line 32 can be chosen from positions pivoting around the second feed point 220 and without overlapping with the first pattern 21, second pattern 22, and the first feed line 31.

In some embodiments, first feed line 31 and the second feed line 32 have a substantially mirror symmetry with respect to the plane of mirror symmetry P. Optionally, the first feed line 31 and the second feed line 32 have a two-fold symmetry with respective to the second two-fold axis 7.

Figure 1C:
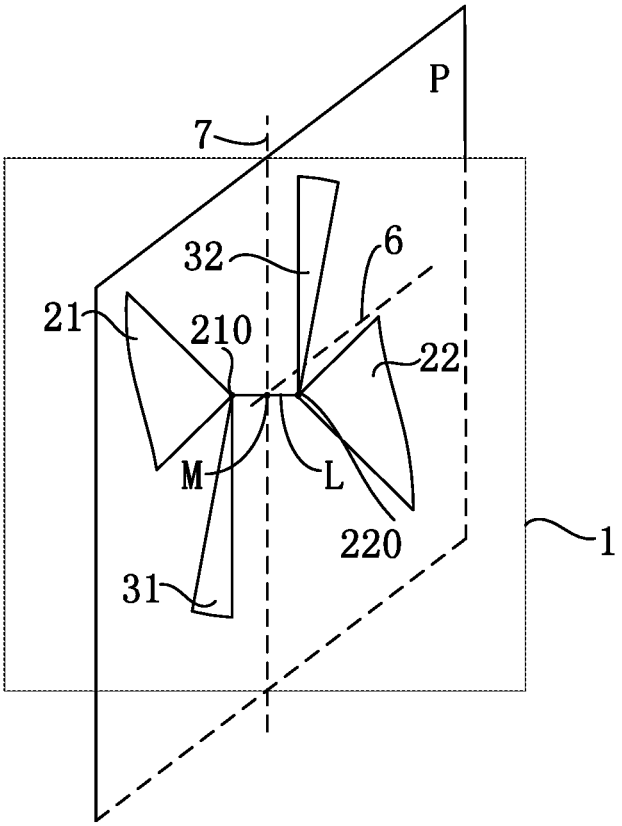
FIG. 1C is a zoom-in view of a first feed point, a second feed point, a first feed line, and a second feed in some embodiments according to the present disclosure.

FIG. 1C is a zoom-in view of a first feed point, a second feed point, a first feed line, and a second feed in some embodiments according to the present disclosure. Referring to FIG. 1C, in some embodiments, the first feed line 31 and the second feed line 32 have a two-fold symmetry with respective to the first two-fold axis 6.

In some embodiments, referring to FIG. 1A, the first feed line 31 and the second feed line 32 have a substantially triangular shape. Optionally, the first feed line 31 has a substantially isosceles triangular shape having the first feed point 210 as one of its apexes, and the second feed line 32 has a substantially isosceles triangular shape having the second feed point 220 as one of its apexes. Optionally, the first feed point 210 is an apex of a vertex angle other than two substantially the same base angles of the first feed line 31, the second feed point 220 is an apex of a vertex angle other than two substantially the same base angles of the second feed line 32. Optionally, one of two right angle sides of the first feed line 31 is directly adjacent to one of two right angle sides of the second feed line 32.

In some embodiments, the first feed line 31 has a rectangular shape, the second feed line 32 has a rectangular shape. Optionally, the first feed line 31 has a trapezoidal shape, the second feed line 22 has a trapezoidal shape.

Figure 3:
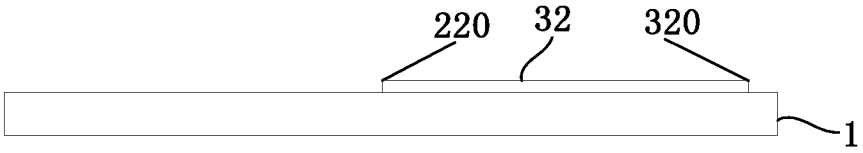
FIG. 3 is a cross-sectional view of a structure of an antenna along an BB' direction in the FIG. 1A.

FIG. 3 is a cross-sectional view of a structure of an antenna along an BB' direction in the FIG. 1A. Referring to FIG. 1A and FIG. 3, in some embodiments, a first side 310 of the first feed line 31 away from the first feed point 210 has a length in a range of approximately 5 mm to approximately 15 mm, e.g., approximately 5 mm to approximately 7 mm, approximately 7 mm to approximately 9 mm, approximately 9 mm to approximately 11 min, approximately 11 mm to approximately 13 mm, and approximately 13 mm to approximately 15 mm.

Optionally, a second side 320 of the second feed line 32 away from the second feed point 220 has a length in a range of 5 mm to 15 mm, e.g., approximately 5 mm to approximately 7 mm, approximately 7 mm to approximately 9 mm, approximately 9 mm to approximately 11 mm, approximately 11 mm to approximately 13 mm, and approximately 13 mm to approximately 15 mm.

Figure 4:
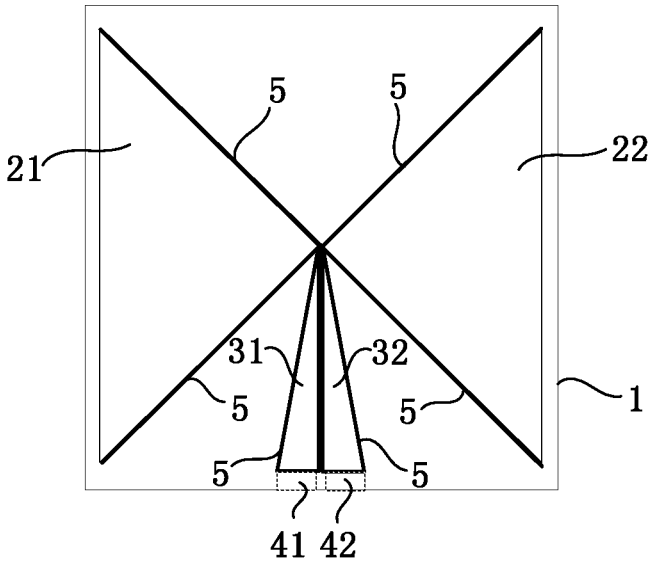
FIG. 4 is a schematic diagram of a structure of an antenna in some embodiments according to the present disclosure.

FIG. 4 is a schematic diagram of a structure of an antenna in some embodiments according to the present disclosure. Referring to FIG. 1A and FIG. 4, in some embodiments, the antenna further includes a first metal structure 41 and a second metal structure 42. Optionally, the first metal structure 41 is electrically connected to the first side 310 of the first feed line 31 away from the first feed point 210. Optionally, the second metal structure 42 is electrically connected to the second side 320 of the second feed line 32 away from the second feed point 220.

Optionally, the first metal structure 41 performs radio frequency (RF) connection between the first feed line 31 and a RF cable. Optionally, the second metal structure 42 performs RF connection between the second feed line 32 and the RF cable. The first metal structure 41, and the second metal structure 42 allow the antenna to have a better RF energy transmission and improve transmission power.

Various materials may be used for making each one of the first metal structure 41 and the second metal structure 42. Examples of materials suitable for making each one of the first metal structure 41 and the second metal structure 42 include, but are not limited to, cooper.

Optionally, the first side 310 of the first feed line 31 is on a first edge of the substantially transparent base substrate 1 closer to the first feed line 31. Optionally, the second side 320 of the second feed line 32 is on a second edge of the substantially transparent base substrate 1 closer to the second feed line 32. Optionally, the first edge and the second edge are the same edge.

Optionally, the first metal structure 41 is disposed on the first edge of the substantially transparent base substrate 1 closer to the first feed line 31 to be electrically connected to the first side 310 of the first feed line 31. Optionally, the second metal structure 42 is disposed on the second edge of the substantially transparent base substrate 1 closer to the second feed line 32 to be electrically connected to the second side 320 of the second feed line 32. It is convenient for the first metal structure 41 to connect the first feed line 31 and the RF cable, and for the second metal structure 42 to connect the second feed line 32 and the RF cable.

In some embodiments, the antenna further includes RF cable connectors respective connected to the first metal structure 41 and the second metal structure 42. Optionally, the RF cable connectors are respectively disposed on the first edge of the substantially transparent base substrate 1 closer to the first side 310 of the first feed line 31 and the second edge of the substantially transparent base substrate 1 closer to the second side 320 of the second feed line 32. By disposing the RF cable connectors, the connection between the first feed line 31, the second feed line 32, and the RF cable connectors is stable. Optionally, the RF cable connectors are respective connected to the first metal structure 41 and the second metal structure 42 by welding.

Figure 5:
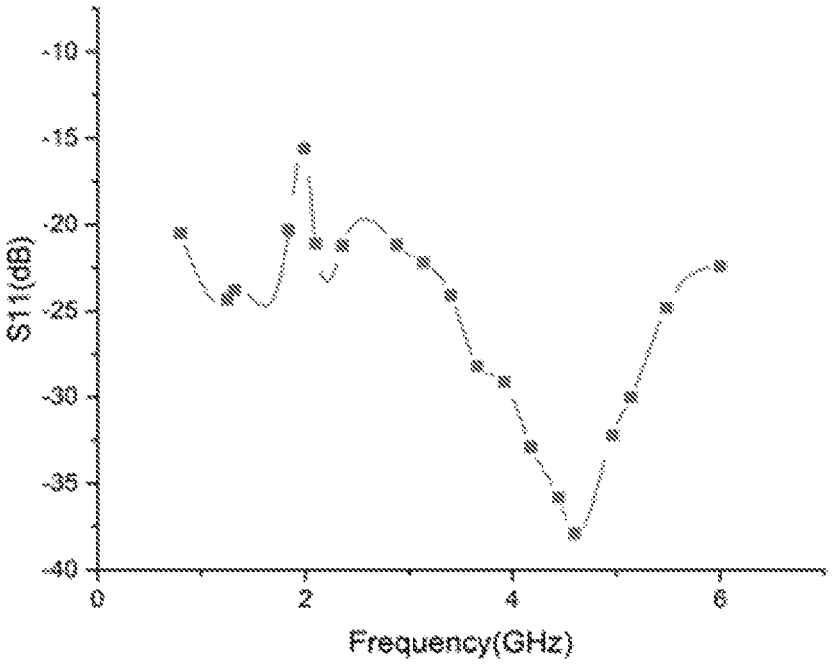
FIG. 5 is a schematic diagram of S11 of an antenna transmitting or receiving a signal having bandwidth from 0.8 GHz to 6 GHz in some embodiments according to the present disclosure.

The present disclosure also analyze the RF energy transmission and the radiation performance of the antenna. FIG. 5 is a schematic diagram of S11 of an antenna transmitting or receiving a signal having bandwidth from 0.8 GHz to 6 GHz in some embodiments according to the present disclosure. S11 represents how much power is reflected by the antenna, and is known as the reflection coefficient. The less power is reflected by the antenna, the more power delivered to the antenna is radiated, so the higher the RF energy transmission efficiency the antenna has.

Optionally, the S11 should be less than −10 dB or −15 dB. Referring to FIG. 5, the antenna transmits or receives a signal having bandwidth from 0.8 GHz to 6 GHz, the values of S11 are less than −15 dB, which means the antenna has a high power transmission efficiency.

FIG. 6 to FIG. 11 are schematic diagrams illustrating radiation patterns of an antenna transmitting or receiving a signal in some embodiment according to the present disclosure. A radiation pattern refers to the directional dependence of the strength of the signals from the antenna. The radiation pattern represents a selectivity of the antenna to radiate signals. For example, along one direction, the radiation is strong, along another direction, the radiation is weak.

Figure 6:
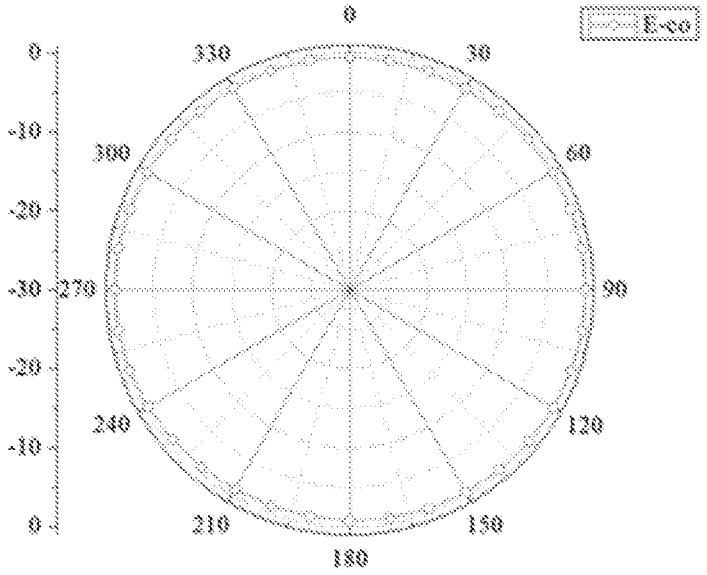
FIG. 6 is a schematic diagram illustrating an E-plane of a radiation pattern of an antenna transmitting or receiving a signal having 0.9 GHz wavelength in some embodiment according to the present disclosure.
Figure 7:
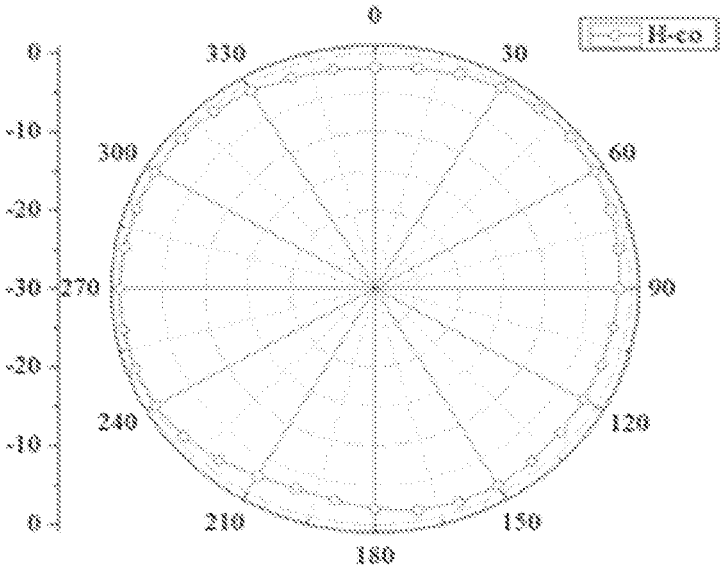
FIG. 7 is a schematic diagram illustrating an H-plane of a radiation pattern of an antenna transmitting or receiving a signal having 0.9 GHz wavelength in some embodiment according to the present disclosure.
Figure 8:
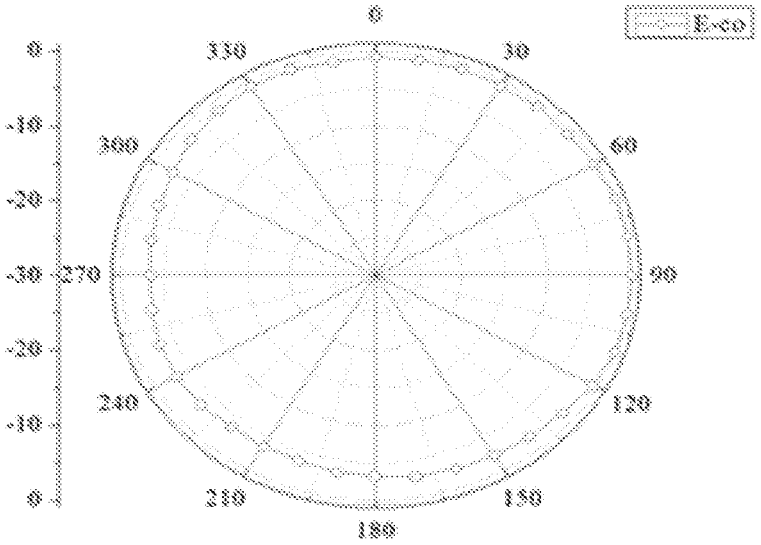
FIG. 8 is a schematic diagram illustrating an E-plane of a radiation pattern of an antenna transmitting or receiving a signal having 2.4 GHz wavelength in some embodiment according to the present disclosure.
Figure 9:
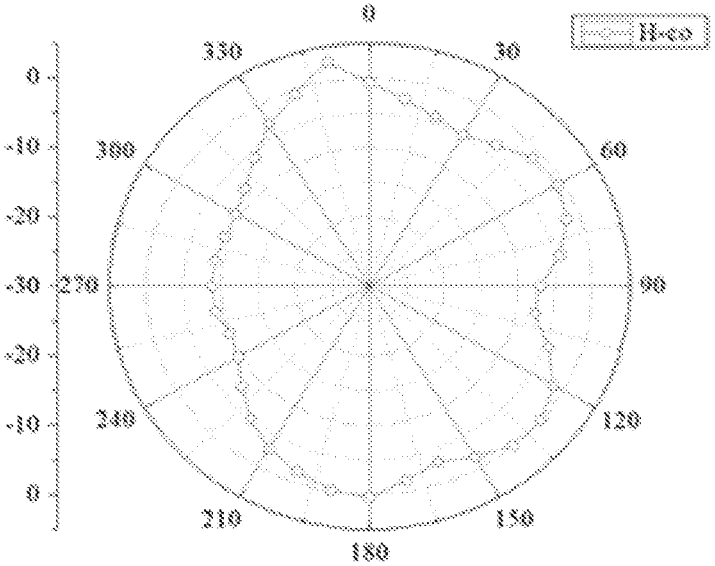
FIG. 9 is a schematic diagram illustrating an H-plane of a radiation pattern of an antenna transmitting or receiving a signal having 2.4 GHz wavelength in some embodiment according to the present disclosure.
Figure 10:
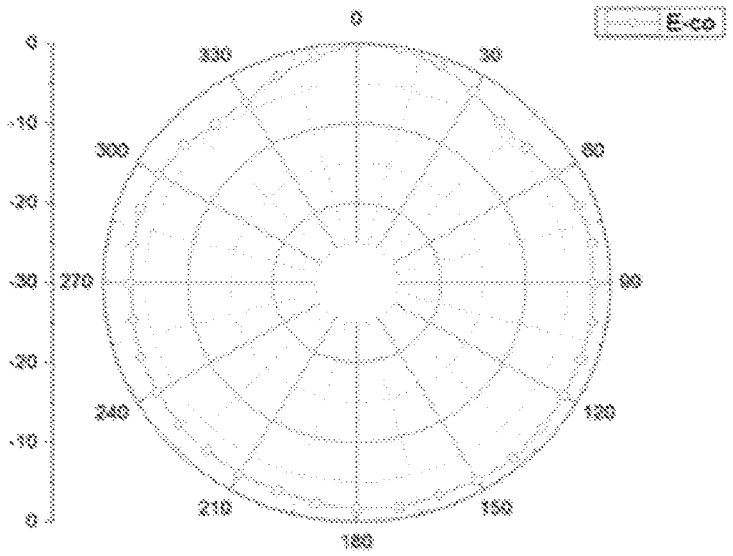
FIG. 10 is a schematic diagram illustrating an E-plane of a radiation pattern of an antenna transmitting or receiving a signal having 4.7 GHz wavelength in some embodiment according to the present disclosure.
Figure 11:
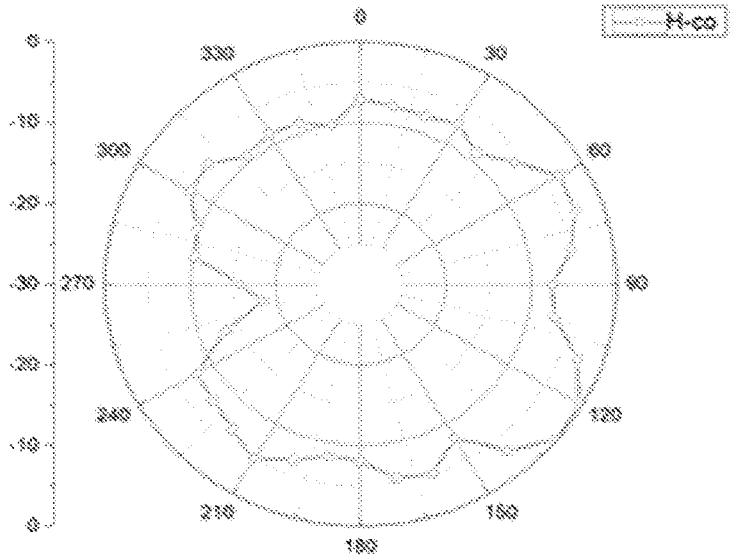
FIG. 11 is a schematic diagram illustrating an H-plane of a radiation pattern of an antenna transmitting or receiving a signal having 4.7 GHz wavelength in some embodiment according to the present disclosure.

FIG. 6 provides an E-plane of a radiation pattern of an antenna transmitting or receiving a signal having 0.9 GHz wavelength. FIG. 7 provides an H-plane of a radiation pattern of an antenna transmitting or receiving a signal having 0.9 GHz wavelength. FIG. 8 provides an E-plane of a radiation pattern of an antenna transmitting or receiving a signal having 2.4 GHz wavelength. FIG. 9 provides an H-plane of a radiation pattern of an antenna transmitting or receiving a signal having 2.4 GHz wavelength. FIG. 10 provides an E-plane of a radiation pattern of an antenna transmitting or receiving a signal having 4.7 GHz wavelength. FIG. 11 provides an H-plane of a radiation pattern of an antenna transmitting or receiving a signal having 4.7 GHz wavelength. The H-plane is perpendicular to the E-plane.

Referring to FIG. 6 to FIG. 11, within a radiation direction ranging from 0° to 180°, the antenna has a relatively high antenna gain when the signals transmitted of received by the antenna have 0.9 GHz wavelength, 2.9 GHz wavelength, and 4.7 GHz wavelength, respectively.

For example, the radiation direction is at 120°, the antenna has a relatively high antenna gain when the signals transmitted of received by the antenna have 0.9 GHz wavelength, 2.9 GHz wavelength, and 4.7 GHz wavelength, respectively.

Optionally, the antenna has a strong radiation in a first space on a side of the first pattern and the second pattern away from the substantially transparent base substrate 1. Optionally, a maximum radiation angle of the antenna in the first space is 120°

Optionally, the antenna has a strong radiation in a second space on a side of the first pattern and the second pattern closer to the substantially transparent base substrate 1. Optionally, a maximum radiation angle of the antenna in the second space is 120°.

In some embodiments, referring to FIG. 4, a plurality of metal nano-wires 5 are respective disposed on sides of the first pattern 21 and the second pattern 22. Because a conductive of a metal material is better than a conductivity of a transparent conductive material, by respectively disposing the plurality of metal nano-wires 5 on sides of the first pattern 21 and the second pattern 22, the power transmission efficiency and the radiation efficiency are improved. Moreover, a respective one of the plurality of metal nano-wires 5 are fine and thin, which has small effect on the transparency of the antenna. And the cost of fabricating the antenna having the plurality of metal nano-wires 5 are low.

It is discovered by this disclosure that when the first pattern 21 and the second pattern 22 have a same isosceles triangular shape, the current density of two legs of the first pattern 21 and the two legs of the second pattern 22 have a maximum value. By disposing the plurality of metal nano-wires 5 on the two legs of the first pattern 21 and the two legs of the second pattern 22, the plurality of metal nano-wires 5 can better improve the power transmission efficiency and the radiation efficiency, and the antenna gain is increased significantly.

Optionally, for the first pattern 21 and the second pattern 22 having a shape other than the isosceles triangular shape, the plurality of metal nano-wire 5 can be disposed in regions of first pattern 21 and regions of the second pattern 22 having a relatively high current density. For example, a metal grid can be disposed in regions of first pattern 21 and regions the second pattern 22.

In some embodiments, the plurality of metal nano-wires 5 are respectively disposed on sides of the first feed line 31 and sides of the second feed line 32, which may improve the RF transmission efficiency, and increase the antenna gain.

In another aspect, the present disclosure also provides a smart window. In some embodiments, the smart window includes the antenna described herein, and one or more signals lines connected to the antenna.

Optionally, a shape of the substantially transparent base substrate can form a shape of the smart window. In one example, subsequent to forming the smart window using the substantially transparent base substrate, other elements of the antenna including, but are not limited to the first pattern, the second pattern, the first feed line, the second feed line are formed on the transparent base substrate. In another example, prior to forming the smart window using the substantially transparent base substrate, other elements of the antenna including, but are not limited to the first pattern, the second pattern, the first feed line, the second feed line are formed on the transparent base substrate.

Figure 12:
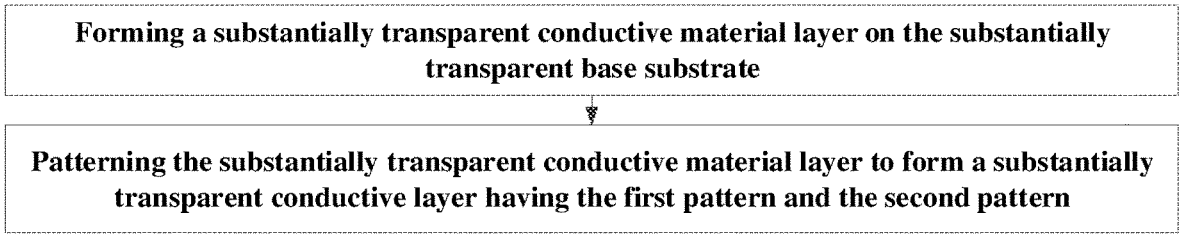
FIG. 12 is a flow chart illustrating a method of fabricating an antenna in some embodiments according to the present disclosure.

FIG. 12 is a flow chart illustrating a method of fabricating an antenna in some embodiments according to the present disclosure. Referring to FIG. 12, in some embodiments, the method of fabricating an antenna includes forming a substantially transparent base substrate; forming a first pattern having a first feed point and a second pattern having a second feed point spaced apart from each other; forming a first feed line electrically connected to the first pattern through the first feed point; and forming second feed line electrically connected to the second pattern through the second feed point. Optionally, the first pattern is formed to have a first width along a first direction, and gradually increasing along a second direction substantially perpendicular to the first direction. Optionally, the second pattern is formed to have a second width along the first direction, and gradually increasing along the third direction substantially opposite to the second direction and substantially perpendicular to the first direction. Optionally, the first feed line is formed to have a third width along a fourth direction, and gradually increasing along the fifth direction substantially perpendicular to the fourth direction. Optionally, the second feed line is formed to have a fourth width along a sixth direction, and gradually increasing along a seventh direction substantially perpendicular to the sixth direction.

FIG. 12 is a flow chart illustrating a method of fabricating an antenna in some embodiments according to the present disclosure. Referring to FIG. 12, in some embodiments, the method further includes forming a substantially transparent conductive material layer on the substantially transparent base substrate. Optionally, the method further includes patterning the substantially transparent conductive material layer to form a substantially transparent conductive layer having the first pattern and the second pattern.

Various method may be included in the process for patterning the substantially transparent conductive material layer. Examples of methods suitable in the patterning process include, but are not limited to, coating photoresist, exposing, developing, etching, and stripping the photoresist.

Optionally, the first pattern and the second pattern together constitutes an antenna electrode.

Optionally, the substantially transparent base substrate includes substantially transparent materials, so the antenna can allow invisible light to transmit therethrough.

In some embodiments, referring to FIG. 1A and FIG. 1B, the first pattern 21 and the second pattern 22 are formed to have a two-fold symmetry with respective to a first two-fold axis 6 intersecting a midpoint M of a line L connecting the first feed point 210 and the second feed point 220, and perpendicular to the substantially transparent base substrate 1.

Optionally, the first pattern 21 and the second pattern 22 are formed have a substantially mirror symmetry with respect to a plane of mirror symmetry P intersecting the midpoint M of the line L connecting the first feed point 210 and the second feed point 220, and perpendicular to the substantially transparent base substrate 1.

Optionally, the first pattern 21 and the second pattern 22 are formed to have a two-fold symmetry with respective to a second two-fold axis 7 on the plane of mirror symmetry P, intersecting the midpoint M, and parallel to the substantially transparent base substrate.

The symmetry arrangements of the first pattern 21 and the second pattern 22, the increasing first width W1 of the first pattern 21, and the increasing second width W2 allows the first pattern 21 and the second pattern 22 to have a broadband impedance characteristics, e.g., an ability to transmit or receive broadband signals. So, the antenna having the first pattern 21 and the second pattern 22 herein has a transparent antenna able to transmit or receives ultra-wideband signals.

In some embodiments, first feed line 31 and the second feed line 32 are formed to have a substantially mirror symmetry with respect to the plane of mirror symmetry P. Optionally, the first feed line 31 and the second feed line 32 have a two-fold symmetry with respective to a second two-fold axis 7 on the plane of mirror symmetry P, intersecting the midpoint M, and parallel to the substantially transparent base substrate 1.

Optionally, referring to FIG. 1C, the first feed line 31 and the second feed line 32 are formed to have a two-fold symmetry with respective to the first two-fold axis 6.

Referring to FIG. 1 to FIG. 3, for example, it is difficult to form a via on the substantially transparent conductive layer containing the first pattern 21 and the second pattern 22, and difficult to weld the first feed line to the first pattern and to weld the second fee line to the second pattern. The antenna adopt same layer two-wire feed mode instead of vertical bottom feed mode. So, the first pattern 21, the second pattern 22, the first feed line 31, and the second feed line 32 are in a same layer.

For example, the first feed line 31 has the third width W3 along the fourth direction D4, of the first feed line 31, gradually increasing along the fifth direction D5 substantially perpendicular to the fourth direction D4. The second feed line 32 has the fourth width W4 along the sixth direction D6, of the second feed line 32, gradually increasing along the seventh direction D7 substantially perpendicular to the sixth direction D6. In order to match an input impedance of the first pattern 21 at the first feed point 210 to a characteristic impedance of the first feed line 31 at the first feed point 210, the third width W3 along the fourth direction D4, of the first feed line 31, is designed to gradually increase along the fifth direction D5 substantially perpendicular to the fourth direction D4. In order to match an input impedance of the second pattern 22 at the second feed point 220 to a characteristic impedance of the second feed line 32 at the second feed point 220, the fourth width W4 along the sixth direction D6, of the second feed line 32, is designed to gradually increase along the seventh direction D7 substantially perpendicular to the sixth direction D6. So, by matching the input impedance of the first pattern 21 to the characteristic impedance of the first feed line 31, and matching the input impedance of the second pattern 22 to the characteristic impedance of the second feed line 32, the antenna can achieve a maximum transmission power, as well as keep the radiation pattern of the antenna stable within the ultra-wideband.

In some embodiments, the method further includes forming a first metal structure 41 electrically connected to a first side 310 of the first feed line 31 away from the first feed point 210, and forming a second metal structure 42 electrically connected to a second side 320 of the second feed line 32 away from the second feed point 220. Optionally, the first metal structure 41 and the second metal structure 42 are made of copper.

Optionally, the first metal structure 41 performs radio frequency (RF) connection between the first feed line 31 and a RF cable. Optionally, the second metal structure 42 performs RF connection between the second feed line 32 and the RF cable. The first metal structure 41, and the second metal structure 42 allow a good RF energy transmission and improve transmission power.

In some embodiments, the method further includes respectively forming a plurality of metal nano-wires 5 on sides of the first pattern 21 and the second pattern 22. Optionally, the plurality of metal nano-wires 5 are formed using nano-deposition process.

Optionally, when the first pattern 21 and the second pattern 22 have a same isosceles triangular shape, the plurality of metal nano-wires 5 are formed on the two legs of the first pattern 21 and the two legs of the second pattern 22.

In some embodiments, the plurality of metal nano-wires 5 are respectively formed on sides of the first feed line 31 and sides of the second feed line 32, which may improve the RF transmission efficiency, and increase the antenna gain.

The foregoing description of the embodiments of the invention has been presented for purposes of illustration and description. It is not intended to be exhaustive or to limit the invention to the precise form or to exemplary embodiments disclosed. Accordingly, the foregoing description should be regarded as illustrative rather than restrictive. Obviously, many modifications and variations will be apparent to practitioners skilled in this art. The embodiments are chosen and described in order to explain the principles of the invention and its best mode practical application, thereby to enable persons skilled in the art to understand the invention for various embodiments and with various modifications as are suited to the particular use or implementation contemplated. It is intended that the scope of the invention be defined by the claims appended hereto and their equivalents in which all terms are meant in their broadest reasonable sense unless otherwise indicated. Therefore, the term "the invention", "the present invention" or the like does not necessarily limit the claim scope to a specific embodiment, and the reference to exemplary embodiments of the invention does not imply a limitation on the invention, and no such limitation is to be inferred. The invention is limited only by the spirit and scope of the appended claims. Moreover, these claims may refer to use "first", "second", etc. following with noun or element. Such terms should be understood as a nomenclature and should not be construed as giving the limitation on the number of the elements modified by such nomenclature unless specific number has been given. Any advantages and benefits described may not apply to all embodiments of the invention. It should be appreciated that variations may be made in the embodiments described by persons skilled in the art without departing from the scope of the present invention as defined by the following claims. Moreover, no element and component in the present disclosure is intended to be dedicated to the public regardless of whether the element or component is explicitly recited in the following claims.

What is claimed is:

1. An antenna, comprising:

a substantially transparent base substrate;

a first pattern having a first feed point and a second pattern having a second feed point spaced apart from each other;

a first feed line electrically connected to the first pattern through the first feed point;

a second feed line electrically connected to the second pattern through the second feed point; and a plurality of metal nano-wires disposed on sides of the first pattern, sides of the second pattern, sides of the first feed line, and sides of the second feed line;

wherein a first width along a first direction, of the first pattern, gradually increases along a second direction substantially perpendicular to the first direction;

a second width along the first direction, of the second pattern, gradually increases along a third direction substantially opposite to the second direction and substantially perpendicular to the first direction;

a third width along a fourth direction, of the first feed line, gradually increases along a fifth direction substantially perpendicular to the fourth direction; and a fourth width along a sixth direction, of the second feed line, gradually increases along a seventh direction substantially perpendicular to the sixth direction.

2. The antenna of claim 1, wherein the first pattern and the second pattern have a two-fold symmetry with respective to a two-fold axis intersecting a midpoint of a line connecting the first feed point and the second feed point, and perpendicular to the substantially transparent base substrate; and the first pattern and the second pattern have a substantially mirror symmetry with respect to a plane of mirror symmetry intersecting the midpoint of the line connecting the first feed point and the second feed point, and perpendicular to the substantially transparent base substrate.

3. The antenna of claim 2, wherein the first feed line and the second feed line have a substantially mirror symmetry with respect to the plane of mirror symmetry.

4. The antenna of claim 2, wherein a first normal distance between the first feed point to a side of the first pattern away from the first feed point is in a range of approximately 10 mm to approximately 100 mm;

a second normal distance between the second feed point to a side of the second pattern away from the second feed point is in a range of approximately 10 mm to approximately 100 mm; and a distance between the first feed point and the second feed point is in a range of approximately 0.1 mm to approximately 10 mm.

5. The antenna of claim 1, wherein the first feed point and the second feed point are closest points between the first pattern and the second pattern with respect to each other.

6. The antenna of claim 5, wherein the first feed line and the second feed line have a substantially right triangular shape; and one of two right angle sides of the first feed line is directly adjacent to one of two right angle sides of the second feed line.

7. The antenna of claim 5, wherein a first side of the first feed line away from the first feed point has a length in a range of approximately 5 mm to approximately 15 mm; and a second side of the second feed line away from the second feed point has a length in a range of approximately 5 mm to approximately 15 mm.

8. The antenna of claim 5, further comprising a first metal structure and a second metal structure;

wherein the first metal structure is electrically connected to a first side of the first feed line away from the first feed point; and the second metal structure is electrically connected to a second side of the first feed line away from the second feed point.

9. The antenna of claim 1, wherein the first pattern, the second pattern, the first feed line, and the second feed line are in a same layer and comprise a same conductive material.

10. The antenna of claim 1, wherein the fourth direction and the six direction are substantially perpendicular to the first direction; and the fifth direction and the seventh direction are substantially parallel to the first direction.

11. The antenna of claim 1, wherein the first pattern has a substantial isosceles right triangular shape having the first feed point as one of its apexes; and the second pattern has an isosceles right triangular shape having the second feed point as one of its apexes.

12. The antenna of claim 1, wherein a signal emitted from the antenna is in a range of approximately 0.8 GHz to approximately 6 GHz.

13. The antenna of claim 1, wherein each of the first pattern and the second pattern comprises indium tin oxide materials.

14. The antenna of claim 1, wherein a surface resistance of each of the first pattern and the second pattern is no more than 10 ohms.

15. The antenna of claim 1, wherein a thickness of each of the first pattern and the second pattern is in a range of approximately 300 nm to approximately 800 nm.

16. The antenna of claim 1, wherein the substantially transparent base substrate is a glass substrate.

17. A smart window, comprising the antenna of claim 1, and one or more signals lines connected to the antenna.

18. The antenna of claim 1, comprising a first unitary structure and a second unitary structure;

wherein the first unitary structure comprises the first feed point, the first pattern, and the first feed line branching out from the first feed point;

the first feed point, the first pattern, and the first feed line are in a same layer;

the second unitary structure comprises the second feed point, the second pattern, and the second feed line branching out from the second feed point;

the second feed point is spaced apart from the first feed point; and the second feed point, the second pattern and the second feed line are in a same layer.

19. A method of fabricating an antenna, comprising:

forming a substantially transparent base substrate;

forming a first pattern having a first feed point and a second pattern having a second feed point spaced apart from each other;

forming a first feed line electrically connected to the first pattern through the first feed point forming second feed line electrically connected to the second pattern through the second feed point; and forming a plurality of metal nano-wires disposed on sides of the first pattern, sides of the second pattern, sides of the first feed line, and sides of the second feed line;

wherein the first pattern is formed to have a first width along a first direction, and gradually increasing along a second direction substantially perpendicular to the first direction;

the second pattern is formed to have a second width along the first direction, and gradually increasing along the third direction substantially opposite to the second direction and substantially perpendicular to the first direction;

the first feed line is formed to have a third width along a fourth direction, and gradually increasing along the fifth direction substantially perpendicular to the fourth direction; and the second feed line is formed to have a fourth width along a sixth direction, and gradually increasing along a seventh direction substantially perpendicular to the sixth direction.

20. The method of claim 19, comprising forming a first unitary structure and forming a second unitary structure;

wherein the first unitary structure is formed to comprise the first feed point, the first pattern, and the first feed line branching out from the first feed point;

the first feed point, the first pattern, and the first feed line are in a same layer;

the second unitary structure is formed to comprise the second feed point, the second pattern, and the second feed line branching out from the second feed point;

the second feed point is spaced apart from the first feed point; and the second feed point, the second pattern and the second feed line are in a same layer.

* * * * *